United States Patent [19]

Cumming

[11] 4,241,377

[45] Dec. 23, 1980

[54] FILM TREATMENT APPARATUS

[76] Inventor: James M. Cumming, 4571 Comber Ave., Encino, Calif. 91316

[21] Appl. No.: 17,469

[22] Filed: Mar. 5, 1979

[51] Int. Cl.[3] ..... B08B 7/04

[52] U.S. Cl. ..... 361/213; 15/1.5 R

[58] Field of Search ..... 15/1.5 R, 306 A, 306 B; 361/213, 214

[56] References Cited

U.S. PATENT DOCUMENTS

| | | | |
|---|---|---|---|
| 3,078,396 | 2/1963 | Engelsted | 361/143 |
| 3,128,492 | 4/1964 | Hanscom et al. | 15/1.5 R |
| 3,644,953 | 2/1972 | Christiansen | 15/1.5 R |

FOREIGN PATENT DOCUMENTS

| | | | |
|---|---|---|---|
| 2338938 | 2/1975 | Fed. Rep. of Germany | 15/306 B |

*Primary Examiner*—Harry E. Moose, Jr.
*Assistant Examiner*—L. C. Schroeder
*Attorney, Agent, or Firm*—William W. Haefliger

[57] ABSTRACT

Apparatus to treat films employs a feed means to feed film into a treatment zone wherein streams of gas disperse dust off film surfaces. Charged ions are also supplied to that zone to neutralize static on those surfaces.

21 Claims, 8 Drawing Figures

FILM TREATMENT APPARATUS

BACKGROUND OF THE INVENTION

This invention relates generally to treatment of film, and more particularly concerns apparatus to remove dust from film slide surfaces guidedly advanced through a treatment zone, charged ions also being employed to neutralize static on such surfaces.

Prior devices have employed nuclear pellets to ionize air blasted over film slides advanced by hand past such devices. The cost of such equipment is objectionable in view of the need for replacement of the nuclear pellets, and also no way was known to effectively treat a large number of such slides advanced in rapid succession. Also, dust temporarily removed from such prior slides tended to settle back on film surfaces.

SUMMARY OF THE INVENTION

It is a major object of the invention to provide apparatus and method overcoming the above problems and deficiencies of prior apparatus to effectively treat a guided succession of slides, or surfaces. Basically, the method of the invention includes:

(a) guiding a succession of the slides or surfaces through a treatment zone, (b) and delivering streams of gas to that zone with angularity relative to the slides or surfaces to glance off opposite faces of such slides or surfaces guided through that zone.

Further, the method may desirably and advantageously include the steps of supplying charged ions to that zone to travel in angular directions defined by said streams for contacting the surfaces and neutralizing static thereon, and also attracting the ions across that zone so that dust is constantly swept by the ionized gas flow out of the treatment zone which is to be kept clean. As a result, slides or surfaces delivered from that zone are static and dust free.

Apparatus contemplated by the invention basically comprises:

(a) means defining a film treatment zone which is endwise open, and including feed means to feed the film endwise into that zone for passage therethrough, and (b) means for supplying streams of gas to said zone and closely adjacent opposite surfaces of the film passing laterally through said treatment zone, to disperse dust from said surfaces away from that zone.

Ion delivering means may advantageously comprise multiple needles projecting through or beside gas delivery orifices in an arm or arms that laterally overlie the treatment zone above and below a succession of slides or surfaces fed and guided through that zone. Such needles may desirably have gold containing tips or bodies to ward off corrosion, and they may be suitably supplied with high voltage as will be described. Ion attraction means is desirably associated with such arms to aid in removing dust laden gas and ions from the treatment zone, such attraction means for example extending within the insulative arms, to avoid arcing from the high voltage charged needles, but exposed at one end of each arm to attract the ions as described.

In addition, the slide feed means typically includes structure to automatically feed and guide a succession of slides through the treatment zone, for most effective cleaning of a large number of slides, or surfaces automatically.

These and other objects and advantages of the invention, as well as the details of illustrative embodiments, will be more fully understood from the following description and drawings, in which:

DRAWING DESCRIPTION

Figure 1:
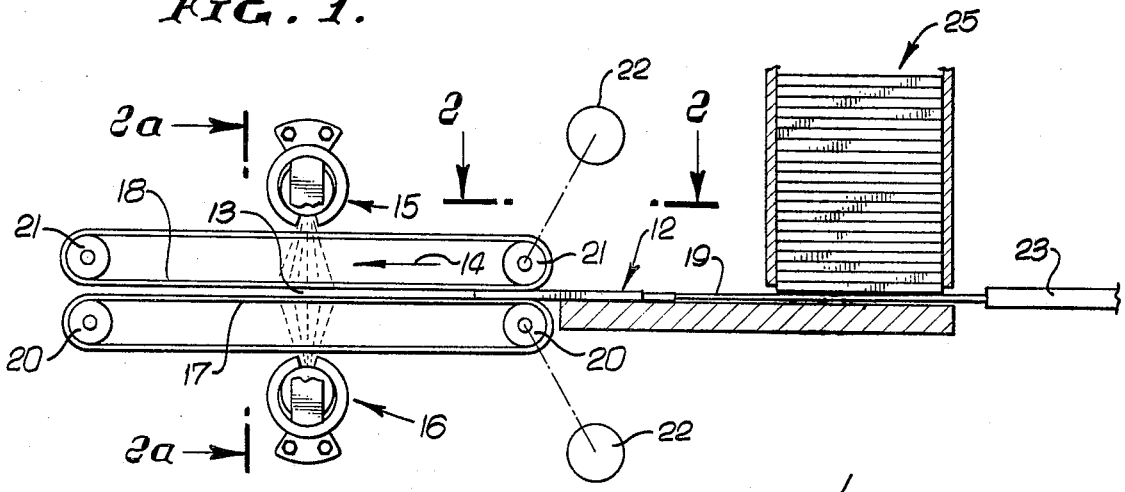
FIG. 1 is a side elevation showing one preferred form of the invention.
Figure 2A:
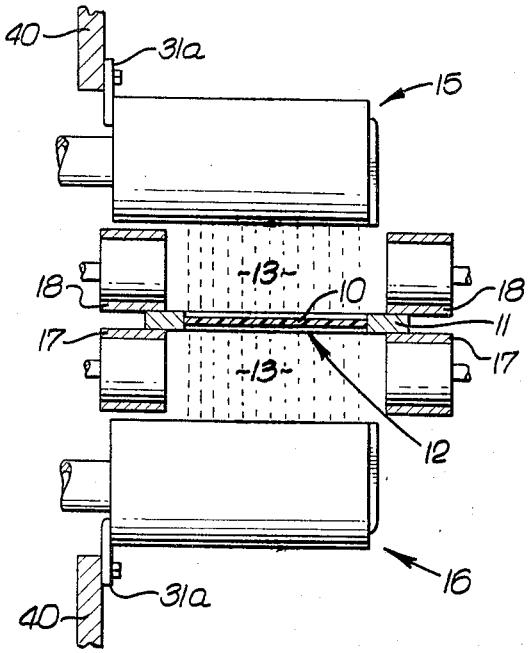
FIG. 2 is a fragmentary plan view on lines 2—2 of FIG. 1.
Figure 3:
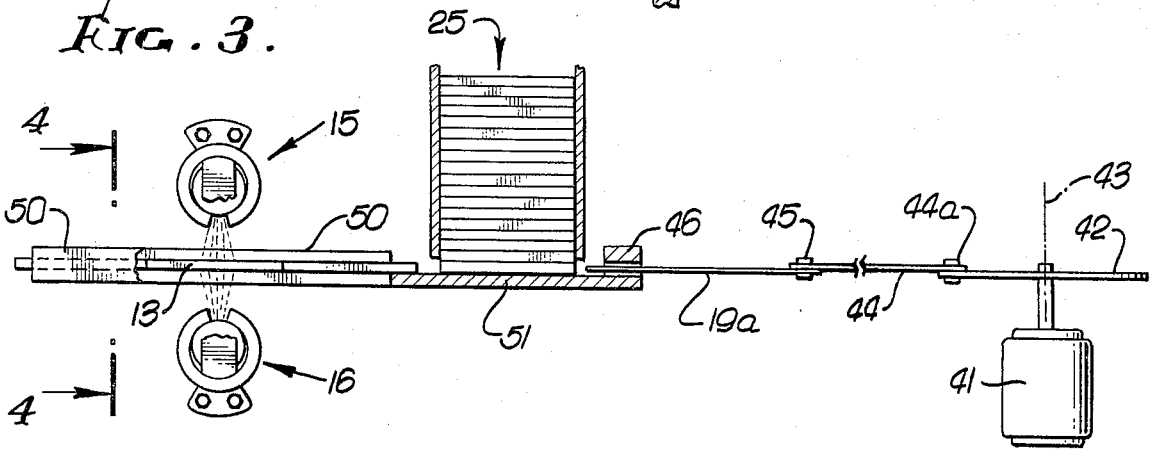
Figure 6:
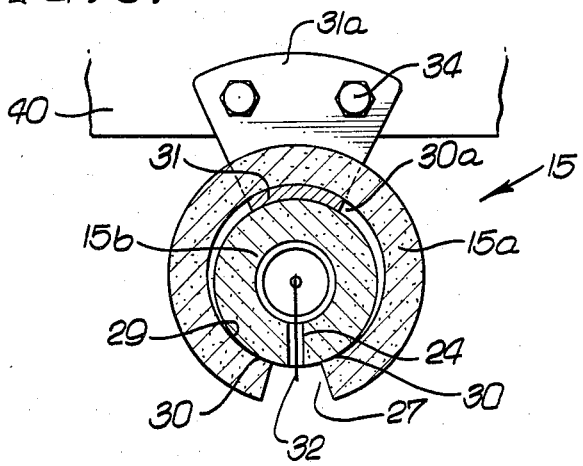
Figure 4:
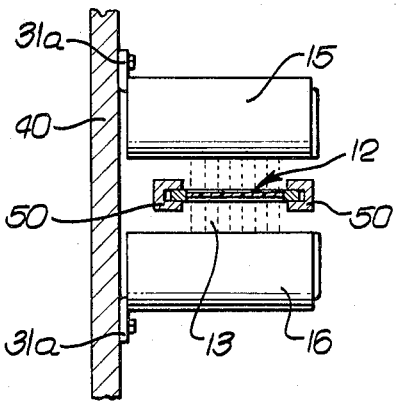
Figure 5:
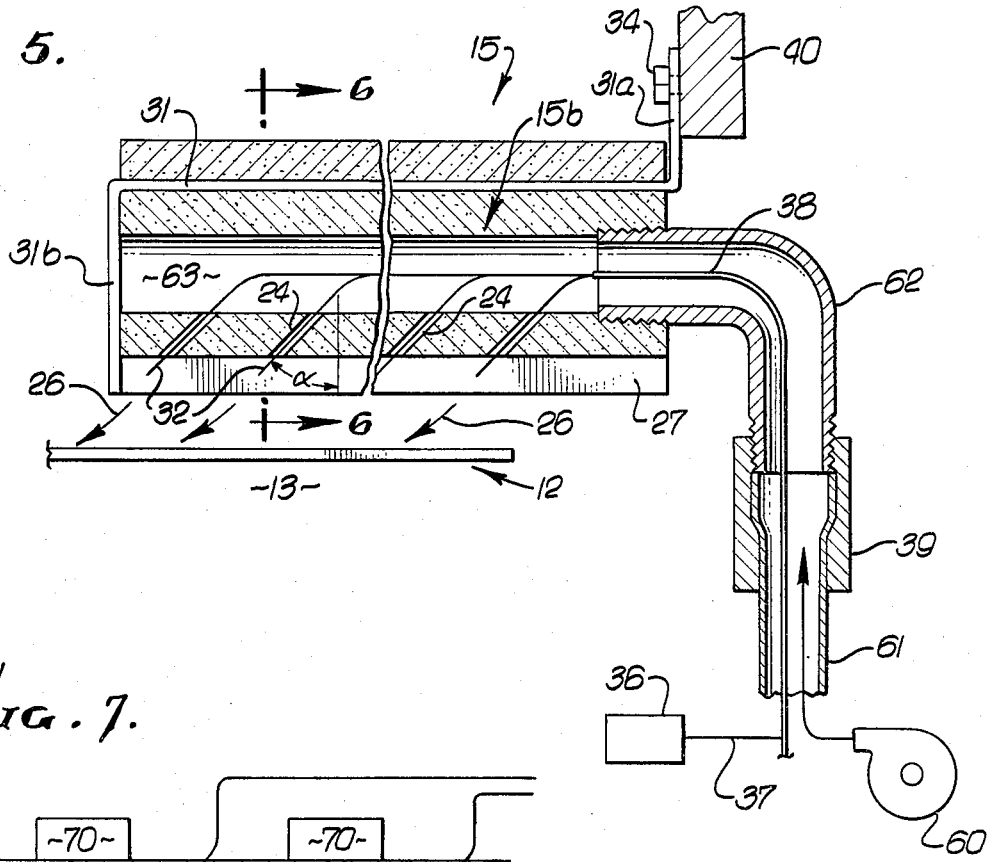

FIG. 2*a* is a section on lines 2*a*—2*a* of FIG. 1;

FIG. 3 is a side elevation showing a modified form of the invention;

FIG. 4 is a section taken in elevation on lines 4—4 of FIG. 3;

FIG. 5 is an enlarged elevation taken through one of the ion dispersing devices used in FIGS. 1 and 3;

FIG. 6 is a section taken in elevation on lines 6—6 of FIG. 5; and

Figure 7:
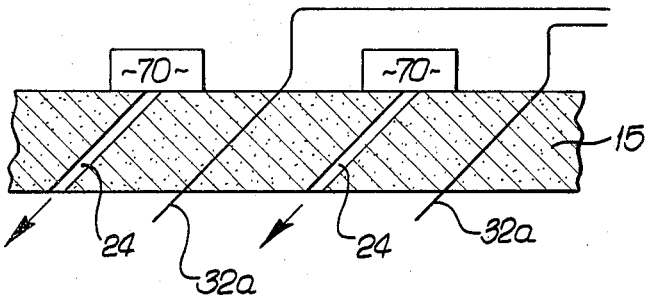

FIG. 7 is a fragmentary view showing a modification.

DETAILED DESCRIPTION

Figure 2:
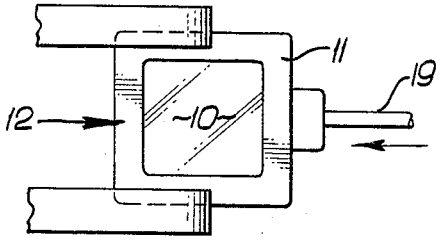

In FIGS. 1 and 2, the apparatus for treating a film (such as a film 10 on a rectangular frame 11 all of which constitutes a film slide 12) includes means defining a film treatment zone 13 which is endwise open in the direction of arrow 14. Such means typically includes upper and lower tubular bodies 15 and 16 extending transversely over the zone 13, as is seen in FIG. 2*a*.

Feed means apparatus is provided to positively feed the film endwise into zone 13 for passage therethrough. Such apparatus may comprise a conveyor and in FIGS. 1–3 takes the form of endless belts or carriers 17 and 18 having parallel stretches arranged as shown to engage opposite faces of slide frames 11 fed leftwardly between the belts as by a pusher 19. The belts are trained about sheaves 20 and 21, and drives for the sheaves are indicated at 22. The pusher 19 is reciprocated endwise by a suitable actuator 23, and successive slides 12 in a stack 25 drop into the path of the pusher upon its full retraction, to be sequentially advanced leftwardly for pick-up by the belts. The latter feed the slides in sequence through zone 13.

Also provided are means to supply streams of gas, via bodies 15 and 16 to zone 13 and closely adjacent opposite sides of the film passing endwise through that zone. Extending the description to FIG. 5 showing the details of only one of the bodies 15, a pump or other source 60 of gas (such as air or nitrogen) is connected to a duct 61 that supplies the gas via elbow fitting 62 to transverse hollow duct 63 within inner portion 15*b* of body 15, for example. The gas escapes from that duct via orifices (or very small diameter passages) 24 through one side of body 15, and slanted toward zone 13 and also laterally, to remove dust from the film opposite surfaces and also disperse the dust particles away from zone 13, i.e. in the direction of arrows 26. FIG. 6 shows that an elongated C-shaped shield 15*a* is split at 27 in registration with the orifices 24, to provide an elongated guide passage for such gaseous streams or jets. The shield also has additional functions, as will appear. Thus, the shield has an inner cylindrical surface 29 engaging the cylindrical surfaces of body inner portion 15*b* at regions 30 adjacent opposite sides of split or gap 27. The shield and body are insulative, as for example resinous, and a gap 30*a* is provided between the top of the elongated split shield and the upper surface of the body. Gap 30*a* passes an electrically conductive metallic strap 31 transversely between opposite ends of the body 15, and the engagement at regions 30 prevents arcing (from high voltage carrying needles 32 extending in orifices 24) to the strap. The strap end is turned at 31*a* to fasten to the housing 40 or other electrical ground at 34. The opposite end of the strap is turned at 31*b* to extend adjacent the free end of the body 15, to attract electrically charged ions toward that end.

Means is provided for effecting delivery of such ions to come in sweeping contact with each of the opposite surfaces of the film passed through zone 13, such means including the above mentioned needles 32. The ions neutralize static on the slides or film, and also aid in sweeping dust off the slides, the amount of air and quantities of ions being such as to achieve this purpose, the angularity $\alpha$ of the needles from normal to the slides aiding in this effect. In this regard, $\alpha$ should be between 30° and 60°. Further, best results are achieved when the voltage applied to the needles is between 3,000 and 10,000 volts, positive or negative as neutralization of the static requires. Strap end 31*b*, being grounded, aids in attracting the ions and the flow of air or gas laterally, to sweep away dust removed from the film surfaces, to enhance the cleaning effect. The needles themselves may desirably have tips with gold surfaces, or the tips or needles may be made of gold, to eliminate corrosion. They protrude slightly from the slanted orifices 24 through which they extend, and into the gap 27 previously described. Alternately, the needles may be located in body 15 spaced from the orifices. A voltage source is indicated at 36 connected at 37 to a lead 38 supplying voltage to all needles. Coupling 39 retains the end of line 61 (that receives lead 38) to the elbow fitting 62.

One usable voltage source (as at 36) is described in U.S. Pat. No. 3,308,344, although others may be used, including an AC source.

The modification shown in FIGS. 3 and 4 includes bodies 15 and 16, and associated needles and gas supply means, the same as described in FIGS. 1, 2, 5 and 6. Also, a reciprocating slide pusher 19*a* corresponds to pusher 19 in FIG. 1, a stack 25 of slides also being provided for gravity feed to the retracted pusher.

A different type pusher actuator includes a rotating drive 41 including a motor, a circular plate 42 driven by the motor about vertical axis 43, and a connecting link 44 pivotally eccentrically attached to the plate 42 at 44*a*, and pivotally attached at 45 to the end of the pusher. A guide for the reciprocated pusher appears at 46.

Edge guides for the frames of slides fed through zone 13 appear at 50. The slides are pushed in sequence by the pusher, along table 51 and into the edge guides 50, so that the slides push each other through the zone 13, as the pusher is advanced leftwardly in FIG. 3.

FIG. 7 shows an alternate means 70 to supply pulsing gas flow to orifices 24 to enhance film cleaning. Also, the needles 32*a*, corresponding to needles 32, are located in the body 15, in spaced relation to the orifices. One such means 70 comprises a rotating shutter; other examples include valve opening and closing, and fluidics switching techniques. Pulsing may be at sonic frequencies.

I claim:

1. In apparatus for treating a film, the combination comprising (a) means defining a film treatment zone and including feed means to feed the film endwise into that zone for passage therethrough, and (b) means including orifices for supplying streams of gas to said zone and closely adjacent opposite surfaces of the film passing laterally through said treatment zone, to disperse dust from said surfaces away from that zone, (c) means including tips to which voltage is supplied for effecting delivery of ions to come in contact with said film surfaces passing laterally through said zone, said tips associated with said orifices so that said ions are delivered into said gas streams, (d) said feed means including an endless conveyor on which film is conveyed within said zone, the conveyor defining an opening through which opposite sides of the film are exposed to said ions and gas streams, the conveyor having spaced support shoulders flatly supporting and positioning edge portions of the film being fed.

2. The combination of claim 1 wherein said tips are located at opposite sides of said zone to face opposite film surfaces.

3. The combination of claim 2 including additional means to supply high voltage so said tips at a level or levels to effect production of ions distributed to neutralize static on the film passed through said zone.

4. The combination of claim 3 where said voltage is between 3,000 and 10,000 maximum.

5. The combination of claim 3 wherein said means to supply voltage includes circuitry to supply alternating voltage at a level of between 3,000 and 10,000 above and below zero.

6. The combination of claim 2 wherein the tips are directed toward said zone and also laterally, there being conductor means exposed to the lateral end of said zone to attract ions laterally across the film.

7. The combination of claim 6 including a first arm carrying said tips at one side of said zone, said conductor means carried by said arm.

8. The combination of claim 6 including first and second arms at opposite sides of said zone, said tips carried by both arms.

9. The combination of claim 2 wherein said tips have surfaces consisting essentially of gold.

10. The combination of claim 7 wherein said tips have surfaces consisting essentially of gold.

11. The combination of claim 1 wherein said feeder means includes a film slide guide extending in alignment with and proximate said zone.

12. The combination of claim 11 wherein said feeder means includes a reciprocating pusher in slide displacing alignment with said guide to displace a succession of slides along the guide within said zone.

13. The combination of claim 1 including a film slide hopper located to feed film slides in a stack and downwardly to a location in alignment with the conveyor.

14. The combination of claim 1 wherein said conveyor shoulders extend in loops for engagement with opposite sides of film slide frame means to convey a film slide within said zone and in alignment with said opposed openings.

15. The combination of claim 3 wherein said voltage supply means includes a lead electrically connected to said tips and extending within a duct defined by said means to supply gas to said zone.

16. The combination of claim 8 wherein each of said arms has an elongated recess sunk therein, said tips located near the bottom of the recess, the tips spaced in a row lengthwise of the recess.

17. The combination of claim 7 wherein said arm includes an insulative core and an insulative shield about the core, said conductor means also extending between the shield and core.

18. In the method of treating photographic film slides to remove dust therefrom, the slides having frames, the steps that include (a) flatly supporting the edge portions of the frames so as to leave the slide films exposed, and guiding a succession of the slides through a treatment zone, (b) and delivering streams of gas to said zone with angularity relative to the slides to glance off opposite faces of the film on such slides guided through that zone.

19. The method of claim 18, including supplying charged ions to said zone to travel in the angular directions defined by said streams for contacting said surfaces for neutralizing static on said surfaces, and attracting said ions across said zone.

20. The method of claim 18 wherein said streams of gas are delivered to said zone as pulses of gas.

21. In apparatus for treating a film, the combination comprising (a) means defining a film treatment zone which is endwise open, and including feed means to feed the film endwise into that zone for passage therethrough, and (b) means for supply streams of gas to said zone and closely adjacent opposite surfaces of the film passing laterally through said treatment zone, to disperse dust from said surfaces away from that zone, (c) said means to supply streams of gas including gas pulsing means.

* * * * *